United States Patent [19]

Kubota et al.

[11] Patent Number: 5,037,077

[45] Date of Patent: Aug. 6, 1991

[54] IMAGE FORMING AFTER-TREATMENT APPARATUS

[75] Inventors: Kazunori Kubota, Yokohama; Hideo Yamazaki, Tokyo, both of Japan

[73] Assignee: Ricoh Company, Ltd., Tokyo, Japan

[21] Appl. No.: 372,458

[22] Filed: Jun. 28, 1989

[30] Foreign Application Priority Data

| | | | |
|---|---|---|---|
| Jul. 1, 1988 | [JP] | Japan | 63-162562 |
| Sep. 30, 1988 | [JP] | Japan | 63-244325 |
| Apr. 14, 1989 | [JP] | Japan | 1-94913 |

[51] Int. Cl.[5] ..... B42B 2/00

[52] U.S. Cl. ..... 270/53; 270/58

[58] Field of Search ..... 270/53, 37, 58

[56] References Cited

U.S. PATENT DOCUMENTS

| | | | |
|---|---|---|---|
| 4,073,391 | 2/1978 | O'Brien | 270/58 |
| 4,479,641 | 10/1984 | Bean | 270/53 |
| 4,607,831 | 8/1986 | Rayback | 270/58 |
| 4,898,372 | 2/1990 | Hirabayashi | 270/53 |

FOREIGN PATENT DOCUMENTS

| | | | |
|---|---|---|---|
| 62-119069 | 5/1987 | Japan | 270/53 |
| 63-109448 | 5/1988 | Japan | 270/53 |

*Primary Examiner*—Edward K. Look
*Assistant Examiner*—Therese M. Newholm
*Attorney, Agent, or Firm*—Oblon, Spivak, McClelland, Maier & Neustadt

[57] ABSTRACT

An image forming after-treatment apparatus for stapling sheets of recording paper discharged from an image forming device comprises a discharging tray device arranged in an upper portion of a machine frame of the apparatus; a staple section arranged in a lower portion of the machine frame; an inlet for the sheets of recording paper discharged from the image forming device; a first passage formed from the inlet to the discharging tray device; a second passage formed from the inlet to the staple section; a third passage formed from the staple section to the discharging tray device; and a stapling device arranged in the staple section and stapling the sheets of recording paper on a recording paper receiving portion. The after-treatment apparatus may comprise a reference side fence for the recording paper disposed in the recording paper receiving portion; a drawing device disposed in the recording paper receiving portion and drawing the recording paper toward the reference side fence; and a device for enabling the stapling device and the reference side fence to be integrally movable in accordance with the size of the recording paper. The after-treatment apparatus may comprise a discharging device disposed in the staple section and discharging the stapled sheets of recording paper and directly connected to the discharging tray without any passage.

9 Claims, 8 Drawing Sheets

IMAGE FORMING AFTER-TREATMENT APPARATUS

BACKGROUND OF THE INVENTION

The present invention relates to an image forming after-treatment apparatus for performing an after-treatment such as a stapling processing with respect to some sheets of recording paper discharged from an image forming device such as a copying machine, a printer, etc.

A conventional image forming after-treatment apparatus is disclosed in Japanese Laid-Open Patent Nos. 62-20046, 62-191375, 62-176246, 62-290669, 59-82263 and 63-101268, etc., for example. In accordance with the construction of such an image forming after-treatment apparatus, as is generally well known, some sheets of recording paper sent out of the image forming device are stored onto a staple tray and are stapled and the stapled sheets of recording paper drop onto a tray arranged downwards and are then discharged.

In such a conventional image forming after-treatment apparatus, the staple tray located upwards obstructs an operation for taking the after-treated sheets of recording paper out of the apparatus. Further, an operator cannot take the sheets of recording paper out of the apparatus unless the operator bends his waist, which is painful for the operator.

Further, in the above-mentioned conventional apparatus, when the after-treatment is performed, it is necessary to align the sheets of recording paper with each other in one place. When the recording paper is stored onto the tray with an end face thereof as a reference, a fence is disposed in a position separated by a predetermined distance from the reference position, and the stapling operation is then performed by a fixed stapling device after the paper is moved and aligned. On the other hand, when the recording paper is stored onto the tray with a center thereof as a reference, jogger fences are reciprocated to align the paper from both sides of this center. Thus, the recording paper is supported by both jogger fences therebetween and is moved to the stapling device fixed in position to perform the stapling operation. In such a conventional apparatus, after the alignment of the sheets of recording paper, it is necessary to move the sheets of recording paper, thereby wasting the time for performing the stapling operation. Further, in another conventional apparatus, the jogger fences are reciprocated to align the recording paper in this center from both sides thereof, and the stapling device is moved to the aligning position to perform the stapling operation. However, in such an apparatus, it takes time to move the stapling device. Further, in another conventional apparatus, a reference fence and the stapling device are fixed in positions separated by a predetermined distance from a maximum size of the paper so that the recording paper hits against the reference fence and is aligned and stapled irrespective of the size of the paper. However, in such a conventional apparatus, when the size of the paper is small, the moving amount of the recording paper is large so that it is difficult to sufficiently move and draw the recording paper to the reference fence.

SUMMARY OF THE INVENTION

It is therefore a first object of the present invention to provide an image forming after-treatment apparatus for easily taking out the recording paper without especially bending the waist of an operator and providing an improved operability.

A second object of the present invention is to provide an image forming after-treatment apparatus for accurately aligning the sheets of recording paper with each other without taking time with end face and center thereof as references to perform the stapling operation.

The above first object of the present invention can be achieved by an image forming after-treatment apparatus for stapling sheets of recording paper discharged from an image forming device, the apparatus comprising a discharging tray device arranged in an upper portion of a machine frame of the apparatus; a staple section arranged in a lower portion of the machine frame; an inlet for the sheets of recording paper discharged from the image forming device; a first passage formed from the inlet to the discharging tray means; a second passage formed from the inlet to the staple section; a third passage formed from the staple section to the discharging tray device; and a stapling device arranged in the staple section and stapling the sheets of recording paper on a recording paper receiving portion.

The second object of the present invention can be achieved by an image forming after-treatment apparatus for stapling sheets of recording paper discharged from an image forming device, the apparatus comprising a recording paper receiving portion for receiving the sheets of recording paper; a stapling device for stapling the sheets of recording paper on the recording paper receiving portion; a reference side fence for the recording paper disposed in the recording paper receiving portion; a drawing device disposed in the recording paper receiving portion and drawing the recording paper toward the reference side fence; and a device for enabling the stapling device and the reference side fence to be integrally movable in accordance with the size of the recording paper.

In addition, the first object of the present invention can be also achieved by an image forming after-treatment apparatus for stapling sheets of recording paper discharged from an image forming device, the apparatus comprising a discharging tray arranged in an upper portion of a machine frame of the apparatus; a staple section arranged in a lower portion of the machine frame; an inlet for the recording paper discharged from the image forming device; a first passage formed from the inlet to the discharging tray; a second passage formed from the inlet to the staple section; a stapling device disposed in the staple section and stapling the sheets of recording paper on a recording paper receiving portion; and a discharging device disposed in the staple section and discharging the stapled sheets of recording paper and directly connected to the discharging tray without any passage.

In accordance with the above-mentioned construction of the present invention, the sheets of recording paper discharged from the image forming device are discharged to the discharging tray arranged in the upper portion of the machine frame of the apparatus when it is not necessary to perform the stapling operation. When it is necessary to perform the stapling operation, the sheets of recording paper discharged from the image forming device are guided once to the staple section arranged in the lower portion of the machine frame and are then stapled by the stapling device. The stapled sheets of recording paper are discharged to the first discharging tray common to that for the unstapled sheets of recording paper, or are discharged to the second discharging tray different from the first discharging tray and arranged in the lower portion of the first discharging tray.

Further, in accordance with the present invention, in the discharging tray, the stapling device and the reference side fence are integrally movable in accordance with the size of the recording paper. The sheets of recording paper are drawn by the drawing device toward the reference side fence and are aligned with each other. Accordingly, the sheets of recording paper can be aligned with each other and stapled with a position suitable for stapling the sheets of recording paper as a reference position. Therefore, it is not necessary to move the sheets of recording paper after the alignment thereof irrespective of the reference position located on an end face or the center of the recording paper, thereby preventing time from being wasted by the movement of the recording paper as in the conventional apparatus.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of an image forming after-treatment apparatus in accordance with the present invention will now be described with reference to the accompanying drawings.

Figure 1:
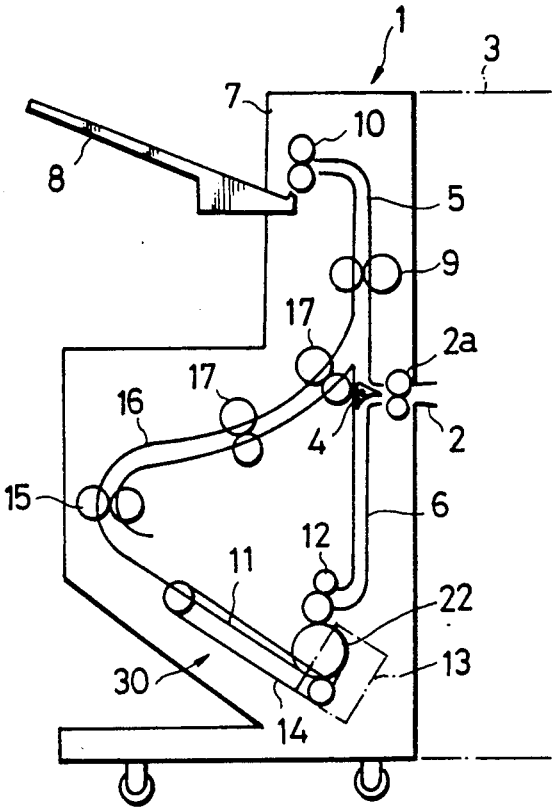
FIG. 1 is a schematically explanatory side view of an image forming after-treatment apparatus in one embodiment of the present invention.

In FIG. 1, a sheet of recording paper, e.g., a sheet of copying paper discharged from image forming device 3 such as a copying machine is fed into inlet 2 of image forming after-treatment apparatus (which is simply called an after-treatment apparatus) 1. First passage 5 and second passage 6 are branched from inlet 2 so as to be switched by switching claw 4.

First passage 5 is formed as a discharging path to discharging tray 8 disposed in an upper portion of machine frame 7 of after-treatment apparatus 1. The recording paper is fed by feed roller 2*a* of inlet 2 and is then fed by guide roller 9 within first passage 5 selectively switched by switching claw 4 and is discharged onto discharging tray 8 by discharging roller 10.

Second passage 6 is formed as a guide path to recording paper receiving portion 11 of staple section 30. The recording paper supplied from inlet 2 sequentially passes through second passage 6 selectively switched by switching claw 4 and is stacked onto recording paper receiving portion 11 by delivery roller 12.

Staple section 30 has stapling device 13 for stapling the sheets of recording paper when the number of sheets of recording paper stacked onto recording paper receiving portion 11 reaches a designated number.

Figure 2:
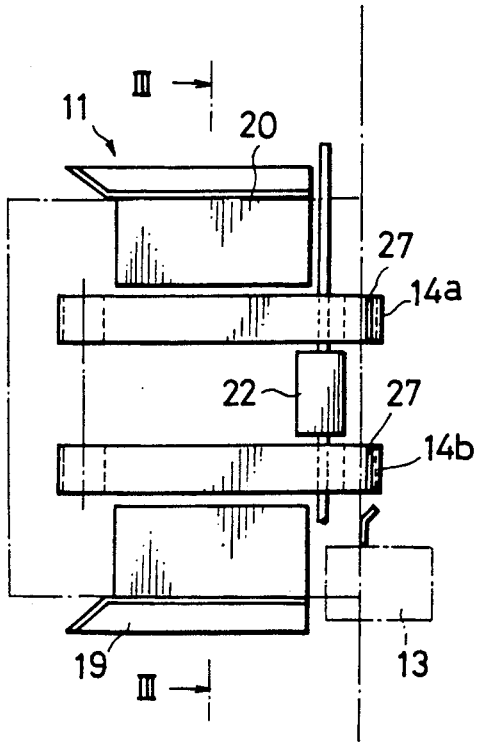
FIG. 2 is a schematically plan view of a staple section of the apparatus.
Figure 3:
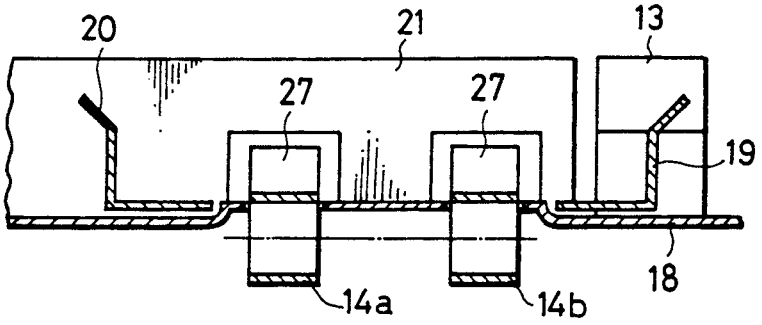
FIG. 3 is a cross-sectional view taken along line III—III of FIG. 2.
Figure 4:
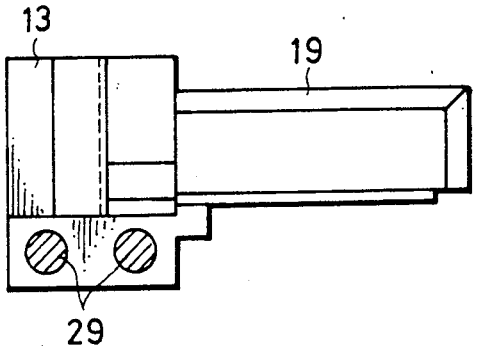
FIG. 4 is a left side view of FIG. 3.

The sheets of recording paper stapled by stapling device 13 on recording paper receiving portion 11 are fed out of recording paper receiving portion 11 slantingly disposed by conveyer belt 14 comprising e.g., two discharging belts 14*a* and 14*b* shown in FIG. 2. The sheets of recording paper are further supported and fed by pull-out roller 15.

Third passage 16 extending from recording paper receiving portion 11 is arranged such that this passage 16 is directed to an intermediate portion of first passage 5 and further reaches discharging tray 8. Guide rollers 17 for feeding the recording paper are suitably arranged in third passage 16.

The recording paper is directly discharged from inlet 2 through first passage 5 to discharging tray 8 arranged in the upper portion of machine frame 7 when it is not necessary to staple the sheets of recording paper. Therefore, the discharged recording paper can be taken out without bending the waist of an operator.

When the sheets of recording paper are stapled, the sheets of recording paper are stacked once through second passage 6 onto recording paper receiving portion 11 arranged in a lower portion of machine frame 7, and are then stapled by stapling device 13. The stapled sheets of recording paper are discharged through third passage 16 onto discharging tray 8. Accordingly, the stapled sheets of recording paper are also discharged onto the same discharging tray 8 so that the operator can take the stapled sheets of recording paper out of the discharging tray without bending his waist or body.

As shown in FIG. 2, stapling section 30 has recording paper receiving portion 11 and stapling device 13.

As shown in FIGS. 2 to 6, recording paper receiving portion 11 has tray 18, reference side fence 19 and jogger fence 20 as a device for drawing the recording paper.

Tray 18 is slantingly arranged such that an upper stream end portion of this tray near the outlet of second passage 6 is low and an outlet side end portion of this tray for discharging the recording paper toward third passage 16 is high. Stopper wall 21 for hitting an end of the recording paper thereagainst is formed in the upper stream end portion of tray 18.

The sheets of recording paper fed through second passage 6 are lowered by the dead weight thereof on slanting tray 18 toward stopper wall 21 and further compulsorily hit against stopper wall 21 by the rotation of brush 22, thereby aligning the ends of the sheets of recording paper with each other.

Figure 7:
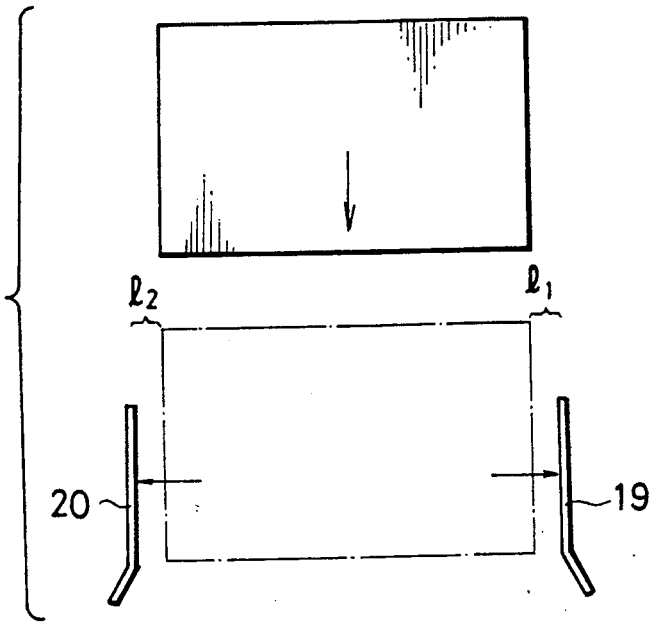
FIG. 7 is a plan view showing arranging states of a reference side fence and another side fence with respect to a recording paper.

When the end face of the recording paper is the reference, the end face of the recording paper on the left-hand side thereof (the lower end face thereof) in FIG. 2 is the reference in the moving direction of the recording paper so that reference side fence 19 fixed in position as the reference is disposed on this left-hand side. Side fence 20 is disposed on the opposite side, e.g., on the right-hand side of the recording paper and is formed as a jogger fence. Side fence 20 is vibrated in the transversal direction and is formed such that the sheets of recording paper hit against reference side fence 19 and the sides thereof are aligned with each other. As shown in FIG. 7 for example, to easily align the sheets of recording paper with each other, reference side fence 19 is fixed in a position separated by preset distance $l_1$ mm from the end portion of the recording paper with respect to the feeding position of the recording paper. Further, jogger fence 20 is located in a position separated by preset distance $l_2$ mm from the end portion of the recording paper in accordance with the size of the recording paper required by the detection thereof in the paper feeding position or a predetermined position of the paper passage. Jogger fence 20 is guided to grooves 23 of tray 18 and movably arranged so as to provide the above construction of fence 20. In the position of jogger fence 20, jogger fence 20 is further reciprocated rightward and leftward several times by an unillustrated stepping motor so that the recording paper is pushed toward reference side fence 19 and moved and hits against reference side fence 19.

When the center of the recording paper is the reference, both reference side fence 19 and stapling device 13 are moved together in accordance with a paper size signal provided by the detection of the paper in an appropriate position such as a position during the feeding operation of the recording paper so that the distance between the end face of the recording paper and reference side fence 19 is set to $l_1$ mm. On the other hand, jogger fence 20 is also stopped once in a position separated by distance $l_2$ from the end face of the recording paper by the operation of the unillustrated stepping motor, and is then reciprocated by the stepping motor at a time point when the fed recording paper is stopped by hitting against stopper wall 21. The above reciprocating movement is repeatedly performed several times until the recording paper hits against reference side fence 19.

Figure 5:
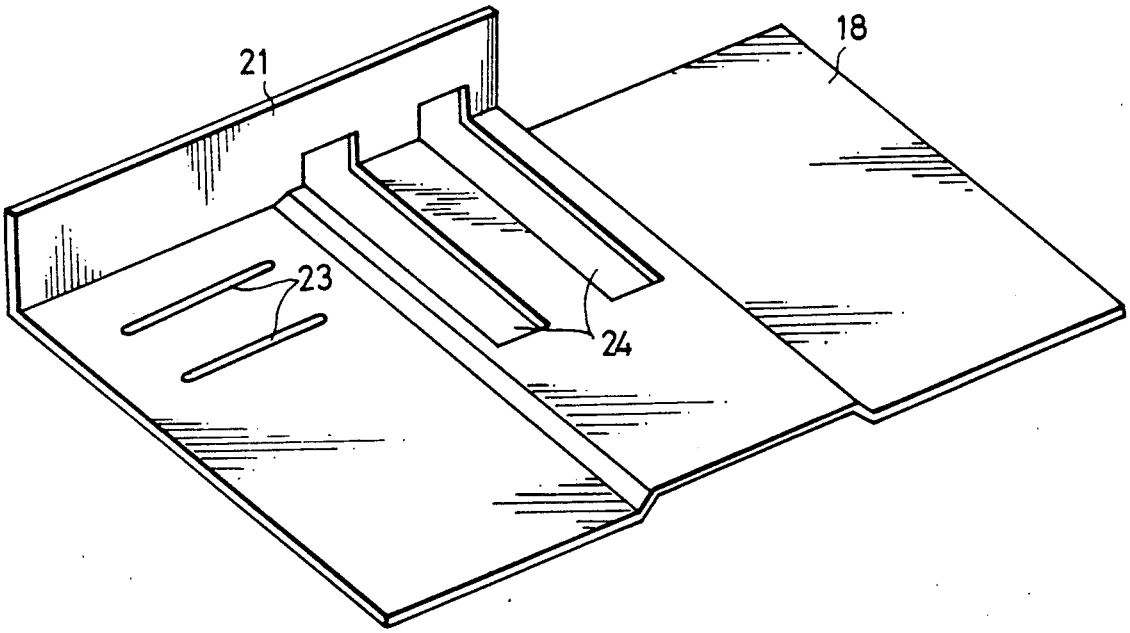
FIG. 5 is a perspective view of a tray.

As shown in FIG. 5, tray 18 is formed to form stepwise a face thereof directly contacting the recording paper and a face for arranging thereon reference side fence 19 and jogger fence 20.

When it is detected that a predetermined number of sheets of recording paper are stacked on tray 18 so as to align the end faces thereof with each other, the sheets of recording paper are stapled by the operation of stapling device 13.

Figure 8:
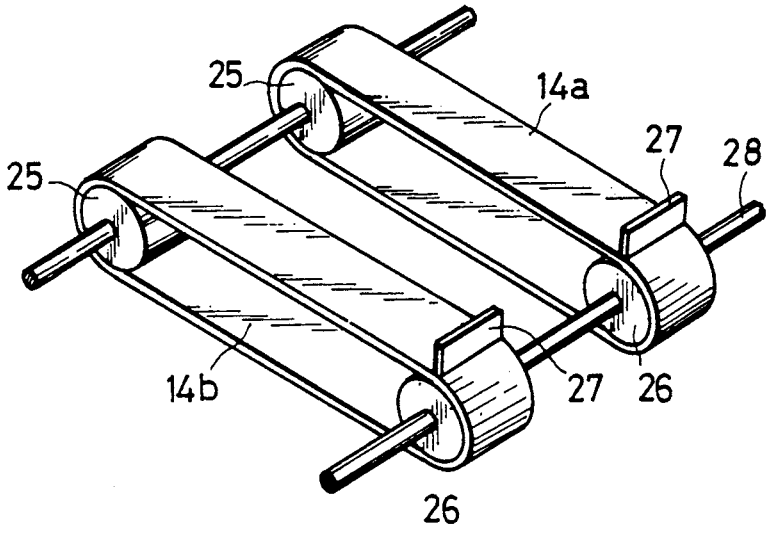
FIG. 8 is a perspective view of a discharging belt.

Notch grooves 24 are formed on a face of tray 18 contacting the recording paper in a rear end portion of the recording paper in the moving direction thereof, i.e., in the vicinity of an end portion of tray 18 in which stopper wall 21 is disposed. As shown in FIG. 8, discharging belts **14*a* and 14*b* are disposed within notch grooves 24 and are partially wound around belt wheels 25 and 26. Pressure plates 27 are respectively fixed to discharging belts 14*a* and 14*b* so as to project upwards from notch grooves 24**.

After the sheets of recording paper are stapled by stapling device 13, pressure plates 27 push the rear ends of the sheets of recording paper by driving discharging belts **14*a* and 14*b* by drive shaft 28 so that the sheets of recording paper are pushed and moved slantingly upwards along tray 18. When the tip ends of the sheets of recording paper are supported and fed by pull-out roller 15, the sheets of recording paper are fed to discharging tray 8 along third passage 16 at a speed faster than the feeding speed of discharging belts 14*a* and 14*b*. When discharging belts 14*a* and 14*b* are rotated once and return to a home position shown in FIGS. 2 and 8, these belts are held in a stand-by position until the next recording paper is fed out. The frictional coefficient of discharging belts 14*a* and 14*b*** is preferably equal to or less than 0.4 for example.

Figure 6:
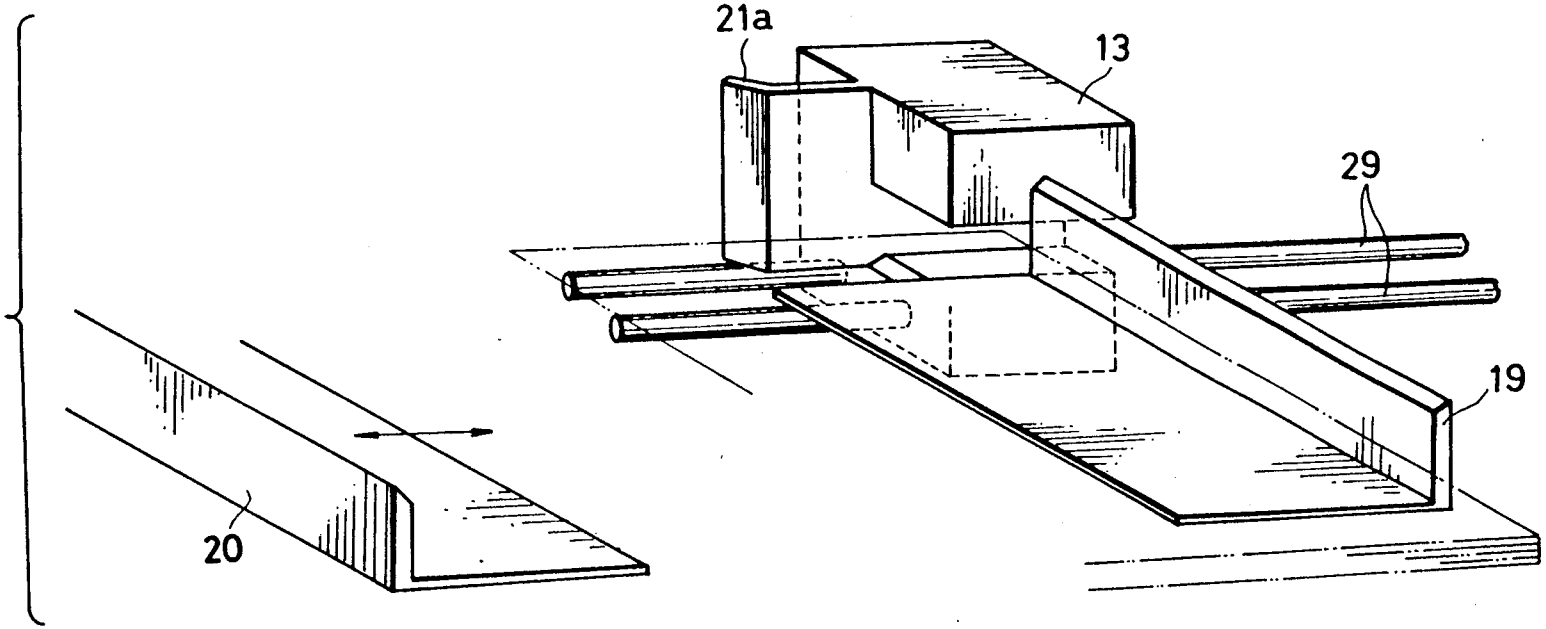
FIG. 6 is a partially perspective view mainly showing a reference side fence and a stapling device.

When the center of the recording paper is the reference, as shown in FIG. 6, reference side fence 19 and stapling device 13 are preferably constructed such that reference side fence 19 and stapling device 13 are integrally joined to each other and are slidably guided by guide shaft 29. At this time, wall portion **21*a* forming a portion of stopper wall 21 can be integrally formed with stapling device 13. Reference side fence 19 and stapling device 13 are moved in accordance with the paper size by unillustrated drive motor and transmitting device in a known method such as a method for moving fence 19 and stapling device 13** by chain.

Figure 9:
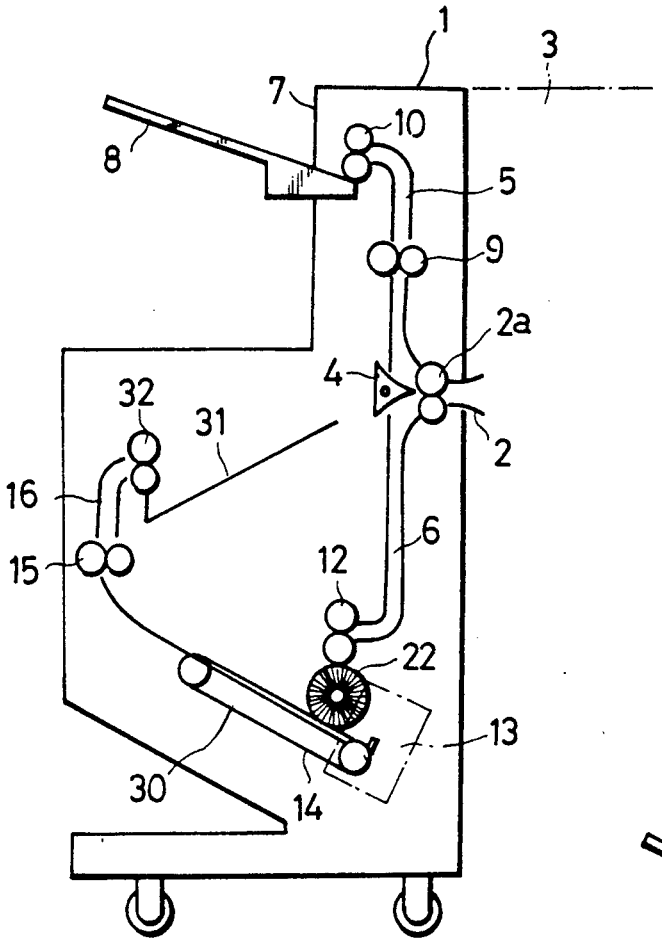
FIGS. 9 and 10 are schematically explanatory views of the image forming after-treatment apparatus corresponding to FIG. 1 in another embodiment of the present invention.
Figure 10:
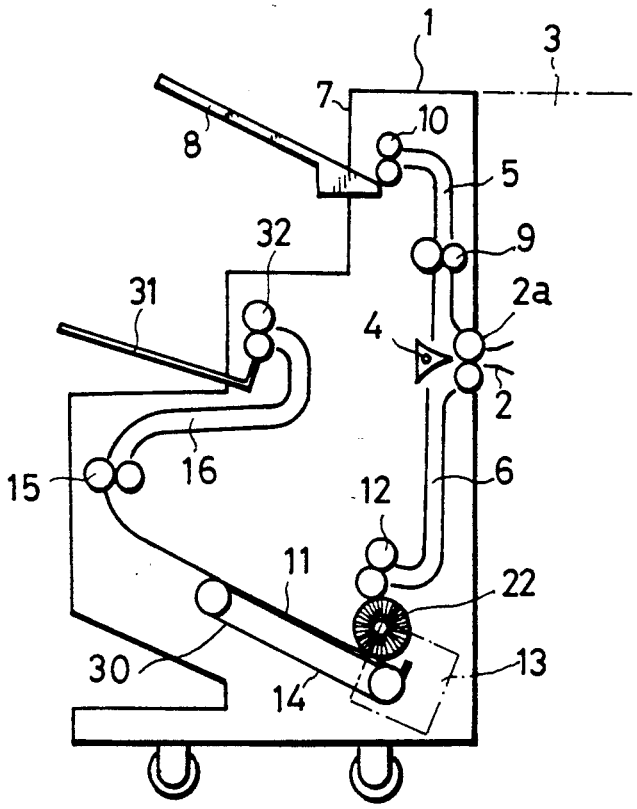

In the above-mentioned embodiment, the sheets of recording paper stapled by the stapling device and the unstapled sheets of recording paper are discharged onto the same discharging tray. However, the above discharging tray may be used for only a first discharging tray for the unstapled sheets of recording paper, and a second discharging tray for the stapled sheets of recording paper may be disposed under the first discharging tray to discharge the sheets of recording paper stapled by the stapling device to the second discharging tray. This embodiment is shown in FIGS. 9 and 10. In these figures, the same or corresponding portions to those in FIG. 1 are designated by the same reference numerals and the explanations thereof are therefore omitted.

Second discharging tray 31 is disposed in a position downward from discharging tray 8 and upward from staple section 30. It is possible to arrange secondary discharging tray 31 within machine frame 7 as shown in FIG. 9 and outside machine frame 7 as shown in FIG. 10.

In FIGS. 9 and 10, when it is not necessary to perform the stapling operation, the recording paper is fed by feed roller **2*a* from inlet 2 to first passage 5 selectively switched by switching claw 4, and is further discharged to discharging tray 8 by guide roller 9 and discharging roller 10**.

The sheets of recording paper to be stapled are sequentially fed by feed roller **2*a* from inlet 2 to second passage 6 selectively switched by switching claw 4. The sheets of recording paper fed to second passage 6 are stacked onto recording paper receiving portion 11 by delivery roller 12**.

When a designated number of sheets of recording paper are stacked onto recording paper receiving portion 11, they are stapled by stapling device 13. The stapled sheets of recording paper are supported and fed by pull-out roller 15 and are then fed out to third passage 16. Different from the embodiment shown in FIG. 1, second discharging tray 31 has an open end portion in third passage 16 in the embodiments shown in FIGS. 9 and 10 and the sheets of recording paper are stacked onto second discharging tray 31 by discharging roller 32.

When second discharging tray 31 is arranged in a high position as much as possible, it is possible to easily take out the sheets of recording paper without bending the waist of the operator.

In the embodiments shown in FIGS. 9 and 10, the discharging path from stapling device 13 to second discharging tray 31 becomes short so that the paper jam during the discharging operation of the recording paper is reduced and it is easy to take out the recording paper.

Figure 11:
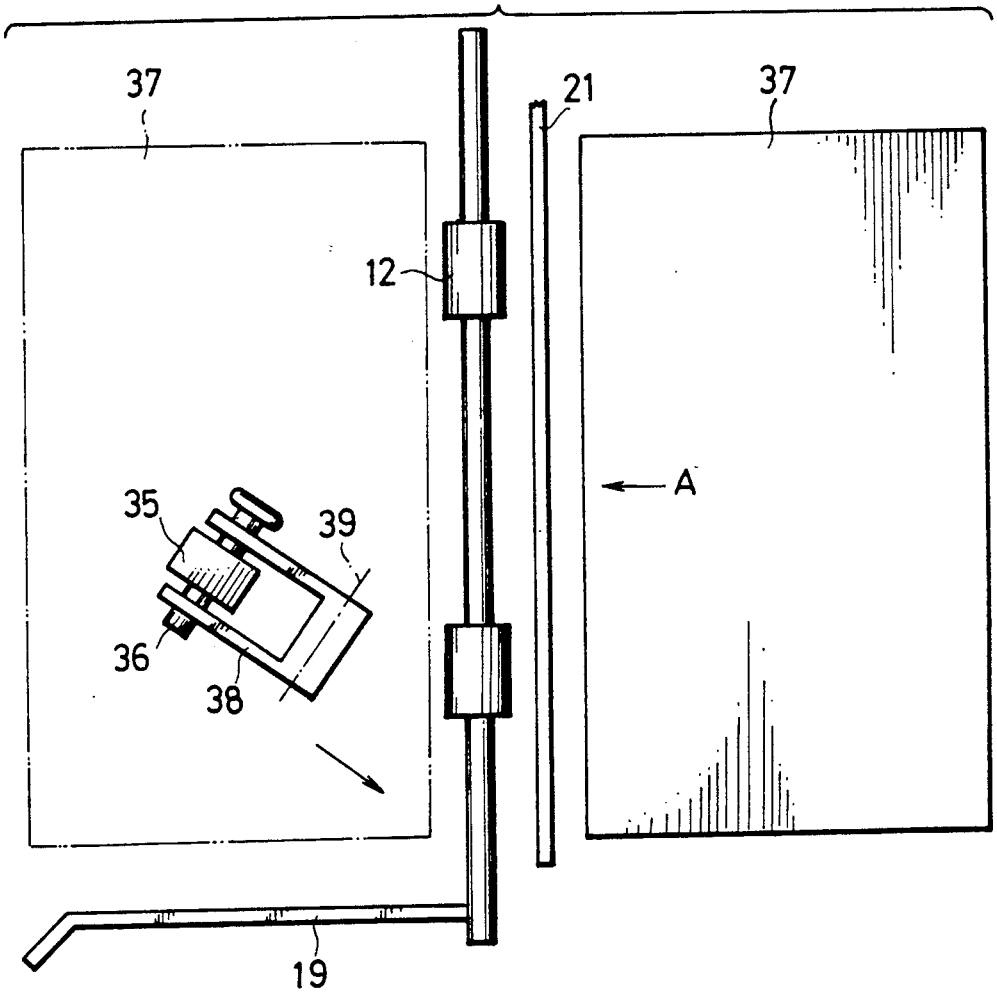
FIGS. 11 and 12 are respectively a schematically plan view and an explanatory side view showing an embodiment of a drawing device.
Figure 12:
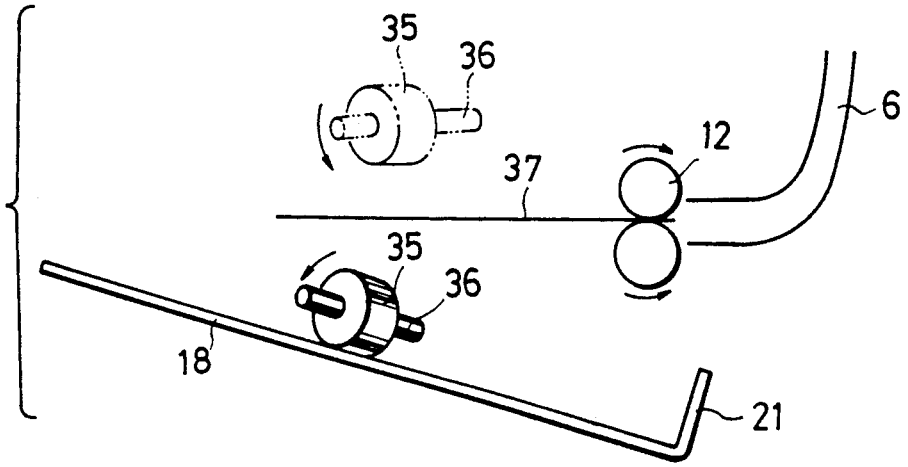
Figure 13:
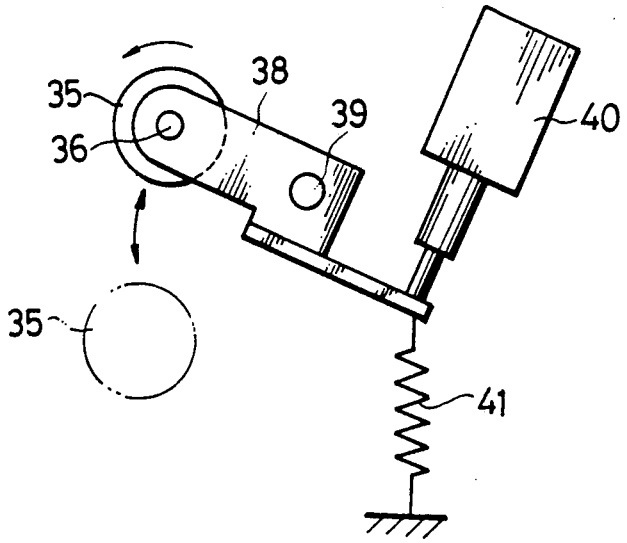
FIG. 13 is an explanatory view showing the mechanism of a support portion of a drawing roller.

Instead of reciprocated jogger fence 20 in the above embodiment, drawing roller 35 can be arranged as the drawing device on tray 18 as shown in FIGS. 11 to 13. Shaft 36 for rotating drawing roller 35 is slantingly arranged with respect to feeding direction A of recording paper 37 and is supported by lever 38. Lever 38 is rotatably supported by support shaft 39. A plunger of solenoid 40 is connected to an end portion of lever 38 opposite to the end portion thereof supporting drawing roller 35.

When recording paper 37 is discharged from second passage 6, solenoid 40 is de-energized and is therefore held by the resilient force of spring 41 in the position shown by chain line in FIG. 12 (the position shown by solid line in FIG. 13) so that the recording paper passes under drawing roller 35 and is discharged to tray 18. After the recording paper has passed through delivery roller 12, solenoid 40 is energized and drawing roller 35 is moved to the position shown by the solid line in FIG. 12 (the position shown by the chain line in FIG. 13). Thus, as shown by the left-hand arrow on the recording paper in FIG. 11, the recording paper is fed in a direction provided by combining the feeding direction fed to stopper wall 21 and the feeding direction fed to reference side fence 19. Thus, the sheets of recording paper are drawn to reference side fence 19 and are aligned with each other.

Figure 14:
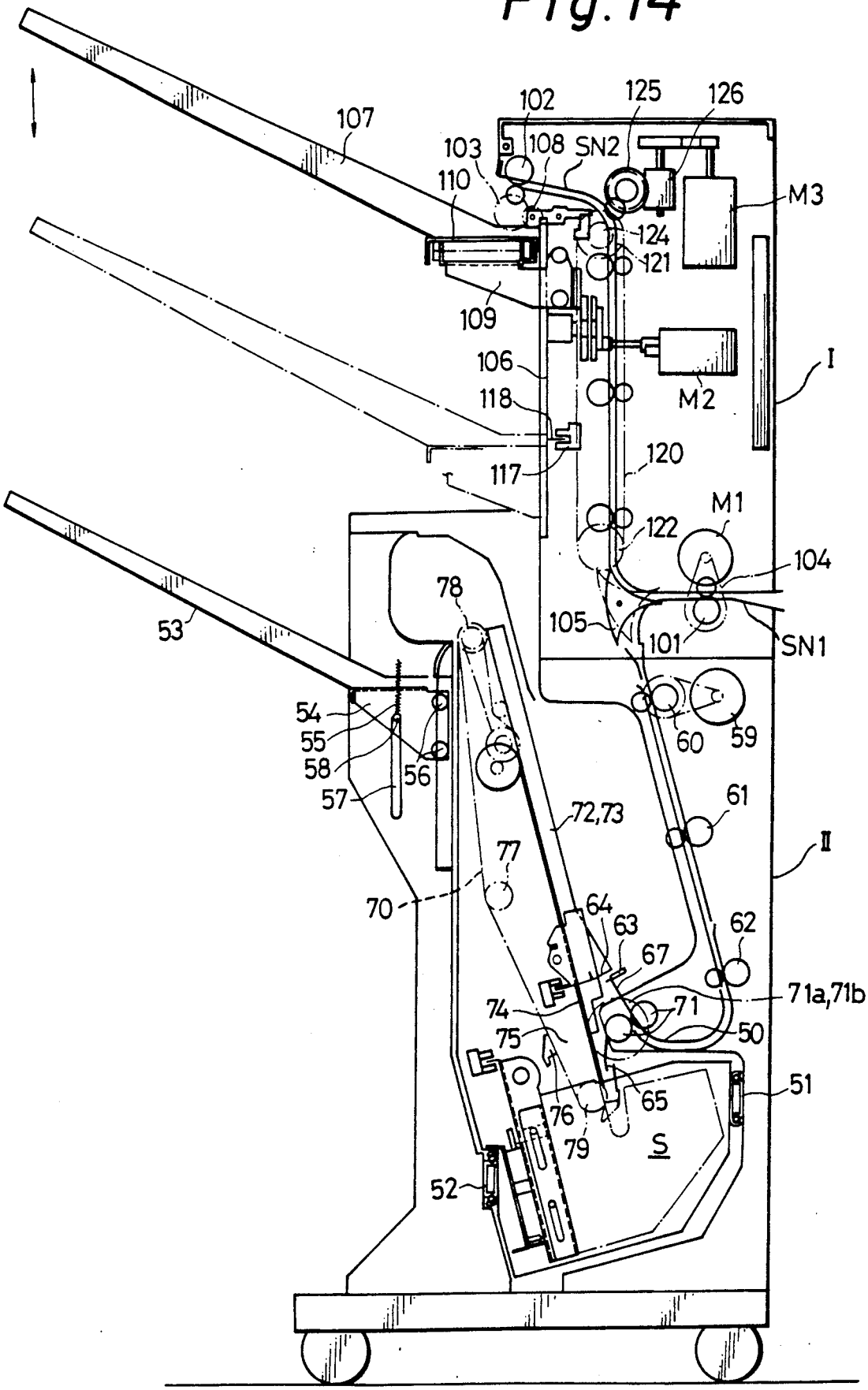
FIG. 14 is a schematically explanatory side view of the image forming after-treatment apparatus in another or third embodiment of the present invention.

FIG. 14 shows an embodiment of the after-treatment apparatus of the present invention in which the third passage is omitted in the respective embodiments mentioned above.

A finisher shown in FIG. 14 is disposed in a side portion of the image forming device which is not shown in this figure, and is constructed by shift-sorting section I on the upper side thereof and staple section II on the lower side thereof.

A plurality of conveying rollers and driven rollers rotated by the conveying rollers are disposed in a conveying path of shift-sorting section I. A rotary shaft of first conveying roller 101 is connected to a rotary shaft of conveying drive motor M1 through first timing belt 104, thereby providing a drive force. The rotary shaft of first conveying roller 101 is further connected by an unillustrated timing belt to a rotary shaft of another conveying roller, a rotary shaft of discharging roller 102 and a rotary shaft of brush 103 for drawing the paper so as to drive these members. Paper detecting sensors SN1 and SN2 are respectively disposed in a constructional portion just before conveying roller 101 in the uppermost stream and a constructional portion just before discharging roller 102 so as to detect the tip end and the rear end of the conveyed paper. Switching claw 105 is disposed in the downstream of first conveying roller 101 so as to change the conveying direction of the recording paper to any one of the shift-sorting section I and the staple section II described later by the action of unillustrated solenoid and spring. In the vicinity of the discharging port, brush 103 for drawing the paper is disposed just under paper-discharging roller 102. The sheets of recording paper dropping onto discharging tray 107 are drawn by the rotation thereof toward hitting plate 106 and hit against this plate 106, thereby aligning the rear ends of the sheets of recording paper with each other.

In a shift drive mechanism, discharging tray 107 is movable in the vertical direction with respect to hitting plate 106 and is moved in association with discharging tray 107 in the forward and backward directions. Hitting plate 106 is constructed to be movable in the forward and backward directions. Hitting plate 106 is reciprocated by an unillustrated crank in the forward and backward directions so that discharging tray 107 restrained with respect to hitting plate 106 in the forward and backward directions is also reciprocated in association with the reciprocating movement of hitting plate 106 in the forward and backward directions. Two shift-detecting plates 118 are projected in hitting plate 106 and the hitting operation and the tray-shift operation are detected by detecting shift-detecting plates 118 by shift-detecting sensors 117 opposed to hitting plate 106.

Pressing roller 108 is supported in hitting plate 106 so as to be rotatable and movable in the vertical direction so that discharging tray 107 and the upper face of the stacked sheets of recording paper are pressed by the dead weight thereof. The sheets of recording paper are inserted under pressing roller 108 by the conveying force by gravitation and paper drawing brush 103, and then hit against hitting plate 106. When discharging tray 107 is shifted by the pressing force by pressing roller 108, the sheets of recording paper are prevented from being shifted. Paper-detecting sensor SN2 is opposed to pressing roller 108 and is arranged on the body side of the apparatus. When the position of pressing roller 108 is raised by stacking the sheets of recording paper, paper-detecting sensor SN2 detects this state and shows that the paper face or the upper face of the discharging tray has reached a predetermined height.

In a vertical drive mechanism, discharging tray 107 is movably supported by tray vertical base 109 through tray support base 110 in the forward and backward directions. Tray vertical base 109 is fixed to timing belt 120 wound around vertical drive pulley 121 and driven pulley 122. Gear 124 having one way clutch therein is attached to vertical drive pulley 121. This one way clutch is constructed to transmit a directional force for lifting up discharging tray 107 to a vertical drive shaft. Gear 124 is connected to vertical drive motor M3 through a series of gears, worm wheel 125, worm 126, etc.

In accordance with the above-mentioned construction, the holding force of worm 126 and the one way clutch are normally locked so that the lowering movement of discharging tray 107 is stopped. When vertical drive motor M3 is rotated in the direction raising discharging tray 107, the one way clutch is locked and pulleys 121 and 122 are rotated so that discharging tray 107 is raised. When vertical drive motor M3 is rotated in the direction lowering discharging tray 107, the one way clutch becomes free so that discharging tray 107 is moved by its dead weight in the downward direction.

When the copying operation begins to be performed, shift motor M2 is driven and hitting plate 106 is moved in the forward and backward directions. In association with this movement of hitting plate 106, discharging tray 107 is also moved in the forward and backward directions so that the shifting operation begins to be performed. When shift sensor 117 detects one shift-detecting plate 118 different from the other shift-detecting plate 118 detected by shift sensor 117 before the shifting operation begins to be performed, the operation of shift motor M2 is stopped by a detecting signal outputted from shift sensor 117, thereby completing the shifting operation. After the completion of the shifting operation, vertical drive motor M3 is driven in the tray-raising direction to raise discharging tray 107. When pressing roller 108 is detected by paper-detecting sensor SN2 after the vertical movement of the tray has been started, the operation of vertical drive motor M3 is stopped by a detecting signal outputted from this sensor, thereby completing the raising operation of discharging tray 107.

Conveying roller 101 receives the sheets of recording paper discharged from the apparatus body at the same linear velocity as the discharging velocity from the apparatus body. When the recording paper is conveyed and first paper-detecting sensor SN1 detects the rear end of the recording paper, the linear velocity is accelerated to a value greater than the discharging velocity of the recording paper discharged from the apparatus body. Then, after a predetermined time has passed since the tip end of the recording paper is detected by second paper-detecting sensor S2, the linear velocity returns to the discharging velocity of the recording paper discharged from the apparatus body, and thereafter the recording paper is discharged to discharging tray 107. The recording paper discharged to discharging tray 107 is inserted under pressing roller 108 by gravitation and the conveying force by the rotation of brush 103 and hits against hitting plate 106, thereby aligning the rear ends of the sheets of recording paper with each other.

At this time, when the sheets of recording paper, the number of which is greater than a predetermined number, are discharged, shift motor M2 is driven by a signal indicative of this state so that the shift operation is started. When one-stroke shifting operation has been completed, the operation of shift motor M2 is stopped. By this stoppage, the stacking position of the recording paper on discharging tray 107 is changed and the sheets of recording paper are sorted. When a series of copying operations are then completed and the final sheet of recording paper has been discharged, vertical drive motor M3 is driven in the downward direction by a signal indicative of the discharging operation of the final sheet of recording paper. Then, after discharging tray 107 is lowered by a predetermined amount, the operation of this motor M3 is completed.

When the sheets of recording paper are stacked by the predetermined amount and approach the discharging port, vertical drive motor M3 is driven in the direction lowering the tray, the locking state of the one way clutch and the holding force of worm 126 are released so that discharging tray 107 is lowered by its dead weight. When the recording paper is lowered by lowering discharging tray 107, the operation of vertical drive motor M3 is stopped and the holding force of worm 126 and the one way clutch are locked, thereby stopping the lowering movement of discharging tray 107. The apparatus is constructed to stop the operation of vertical drive motor M3 while discharging tray 107 is lowered, thereby preventing discharging tray 107 from being further lowered.

In a mechanism for moving stapler S in staple section II, stapler S is engaged with an engaging member so as to be movable in the forward and backward directions. In the mechanism for moving the jogger fences, left and right jogger fences 72 and 73 are arranged such that these fences have a function for aligning the sheets of recording paper with each other in the stapling operation and extend from a place near discharging roller 71 to a place near paper-discharging tray 53 so as to function as guide members when the stapled sheets of recording paper are discharged. A rear end fence for holding lower end edges of the stapled sheets of recording paper is disposed in lower ends of left and right jogger fences 72 and 73. Left and right jogger fences 72 and 73 are constructed to be oppositely reciprocated in the forward and backward directions.

In an emitting belt mechanism constituting a discharging device, endless emitting belt 70 is wound through intermediate roller 77 between drive pulley 78 and fixed pulley 79 arranged in a lower portion of drive pulley 78, thereby transmitting a belt drive force from a belt drive motor. Projecting claw 76 is disposed in a midway face portion of emitting belt 70 to grip the sheets of recording paper from the lower side thereof. Home-position sensor 75 for detecting the position of claw 74 is disposed on the interior side of emitting belt 70 so as to detect a home position (HP) of claw 76. Conveying velocity $V_2$ of emitting belt 70 is set to be a speed equal to or slightly greater than linear velocity $V_1$ of the discharged paper of paper-discharging roller 71, so that the sheets of recording paper to be processed next are not discharged together with the sheets of recording paper already stapled.

The respective mechanisms of such a stapler are constructed to form one unit and are supported such that these mechanisms are pulled out on the operator's side by guide rails 51 and 52.

In the paper-discharging tray mechanism, a base portion of paper-discharging tray 53 is fixed onto tray base 54. Guide rollers 56 are rotatably attached to tray base 54. Guide rollers 56 are engaged with an unillustrated guide rail so that paper-discharging tray 53 is moved together with tray base 54 in the vertical direction. Tray base 54 is biased by lift spring 55 in the upward direction.

A drive force is transmitted from conveying motor 59 through an unillustrated belt to conveying rollers 60, 61 and 62. Further, a drive force is transmitted from conveying motor 59 through an unillustrated belt to discharging roller 71. Left and right brushes **71*a* and 71*b* are attached to rotary shafts of discharging rollers 71 and are constructed to be rotated in synchronization with discharging roller 71**.

In the embodiment shown in FIG. 14, the discharging device is constituted by emitting belt 70, etc. for discharging the stapled sheets of recording paper and is directly connected to paper-discharging tray 53 without any passage. Accordingly, a space for disposing the discharging passage is omitted so that the apparatus can be made compact and it is easier to take out the stapled sheets of recording paper.

As mentioned above, in accordance with the present invention, the discharging tray is arranged above the machine frame so that the taking-out operation of the sheets of recording paper is simplified.

Further, in accordance with the present invention, the side fence can be moved in accordance with the size of the recording paper and the sheets of recording paper can be automatically aligned with each other in a reference position suitable for stapling the sheets of recording paper. Therefore, it is not necessary to move the sheets of recording paper to perform the stapling operation so that it takes no time to perform the stapling operation.

Further, in accordance with the present invention, the reference side fence and the stapling device are simultaneously moved integrally with each other in accordance with the size of the recording paper. Accordingly, the sheets of recording paper can be automatically aligned with each other in the reference position suitable for stapling the sheets of recording paper. Since it is not necessary to move the sheets of recording paper to perform the stapling operation, no time for moving the stapling device is needed. Accordingly, the sheets of recording paper can be reliably aligned with each other and stapled without wasting time.

Many widely different embodiments of the present invention may be constructed without departing from the spirit and scope of the present invention. It should be understood that the present invention is not limited to the specific embodiments described in the specification, except as defined in the appended claims.

What is claimed is:

1. An image forming after-treatment apparatus for stapling sheets of recording paper discharged from an image forming device, said apparatus comprising:

discharging tray means arranged in an upper portion of a machine frame of the apparatus;

a staple section arranged in a lower portion of the machine frame;

an inlet for the sheets of recording paper discharged from the image forming device;

a first passage formed from the inlet to the discharging tray means;

a second passage formed from the inlet to the staple section;

a third passage formed from the staple section to the discharging tray means;

a recording paper receiving portion disposed in the staple section for receiving the sheets of recording paper; and a stapling device disposed in the staple section for stapling the received sheets of recording paper on the recording paper receiving portion.

2. An image forming after-treatment apparatus as claimed in claim 1, wherein said discharging tray means comprises a first discharging tray arranged in the upper portion of said machine frame and a second discharging tray arranged below the first discharging tray, and said staple section is arranged in a lower portion of the second discharging tray.

3. An image forming after-treatment apparatus as claimed in claim 1 or 2, wherein a reference side fence for the recording paper on the recording paper receiving portion and a drawing device for drawing the sheets of recording paper toward the reference side fence are further disposed in the staple section.

4. An image forming after-treatment apparatus as claimed in claim 3, wherein said stapling device and the reference side fence are formed to be integrally movable in accordance with the size of the recording paper.

5. An image forming after-treatment apparatus as claimed in claim 4, wherein a discharging device for discharging the stapled sheets of recording paper is further disposed in the staple section.

6. An image forming after-treatment apparatus as claimed in claim 5, wherein the drawing device is formed as a jogger fence which can be reciprocated toward the sheets of reference side fence.

7. An image forming after-treatment apparatus as claimed in claim 5, wherein the drawing device is formed as a drawing roller arranged on the tray means and drawing the sheets of recording paper toward the reference side fence.

8. An image forming after-treatment apparatus for stapling sheets of recording paper discharged from an image forming device, said apparatus comprising:

discharging tray means arranged in an upper portion of a machine frame of the apparatus;

a staple section arranged in a lower portion of the machine frame;

an inlet for the sheets of recording paper discharged from the image forming device;

a first passage formed from the inlet to the discharging tray means;

a second passage formed from the inlet to the staple section;

a recording paper receiving portion disposed in the staple section for receiving the sheets of recording paper;

a stapling device disposed in the staple section for stapling the received sheets of recording paper on the recording paper receiving portion; and a discharging device directly connected to said discharging tray means for discharging the stapled sheets of recording paper to said discharging tray means.

9. An image forming after-treatment apparatus as claimed in claim 8, wherein the discharging device comprises an emitting belt for discharging the stapled sheets of recording paper.

* * * * *